US005429238A

United States Patent [19]

Fritz

[11] Patent Number: 5,429,238

[45] Date of Patent: Jul. 4, 1995

[54] COMIC BOOK PROTECTION APPARATUS

[76] Inventor: Wayne L. Fritz, 816 N. 123rd Ct., Omaha, Nebr. 68154

[21] Appl. No.: 203,310

[22] Filed: Mar. 1, 1994

[51] Int. Cl.[6] ..... A45F 5/12

[52] U.S. Cl. ..... 206/424; 281/34; 281/20

[58] Field of Search ..... 281/34, 35, 20, 29; 206/424, 472; 383/106

[56] References Cited

U.S. PATENT DOCUMENTS

| | | | |
|---|---|---|---|
| D. 322,097 | 12/1991 | Fritz | D20/42 |
| D. 325,393 | 4/1992 | Schertz et al. | D19/26 |
| 1,207,396 | 12/1916 | Gordon . | |
| 1,330,894 | 2/1920 | Muffley . | |
| 2,302,153 | 11/1942 | Spinner | 206/424 X |
| 2,728,450 | 12/1955 | Haire | 206/424 X |
| 2,808,274 | 10/1957 | Goldman | 281/20 |
| 4,128,262 | 12/1978 | Du Corday | 281/34 |
| 4,477,013 | 10/1984 | Herrin | 229/1.5 R |
| 4,861,073 | 8/1989 | Poretsky | 281/45 |
| 4,932,683 | 6/1990 | Perazza | 283/74 |
| 5,029,900 | 7/1991 | Axelrod | 281/34 |
| 5,052,717 | 10/1991 | Ninomiya et al. | 281/21.1 |

*Primary Examiner*—David T. Fidei
*Attorney, Agent, or Firm*—John A. Beehner

[57] ABSTRACT

A comic book protection apparatus includes a document cover having generally flexible, generally rectangular front and rear panels each having at least one longitudinal edge, the edges positioned in vertical spaced relation. A spine extends between and is connected to one of the longitudinal edges of each of the front and rear panels. The spine is connected to the front and rear panels at generally right angles thereby forming a comic book receiving channel. The cover is constructed of a generally translucent material and is of a size and shape to substantially cover and protect a comic book between the front and rear panels. Finally, the document cover may be inserted into a generally rectangular cover-receiving envelope having front and rear envelope panels, the panels being connected to each other on at least two sides. The envelope is of a size and shape to receive and enclose the document cover between the front and rear envelope panels and is constructed of a generally translucent material.

11 Claims, 2 Drawing Sheets

COMIC BOOK PROTECTION APPARATUS

BACKGROUND OF THE INVENTION

1. Technical Field

This invention relates to an apparatus for protecting documents and more particularly, to a comic book protection apparatus including a document cover having generally flexible, generally rectangular front and rear panels connected to one another by a generally rectangular spine, the cover constructed of a generally translucent material and being of a size and shape to substantially cover and protect a comic book between the front and rear panels, and a cover-receiving envelope having front and rear envelope panels, the panels connected to each other on at least two sides, the envelope being constructed of a generally translucent material and being of a size and shape to receive and enclose the document cover between the front and rear envelope panels.

2. Description of the Prior Art

Comic book collecting has rapidly grown from nothing more than a child's hobby to a substantial section of the collectables market. However, due to the size of comic books as compared to other types of collectibles such as baseball cards, storage and protection of comic books can cause problems for collectors. There is therefore a need for a comic book protection apparatus.

Additionally, collectors who wish to occasionally thumb through their comic books must remove the comic book from the enclosing protective device and then contact the pages with their fingers while thumbing through the comic book. This results in transfer of finger tip oils and prints to the surface of the comic book and the pages of the book, oils and prints which can mar or destroy the ink-printed drawings in the comic book. Most importantly, these oils and prints can damage or destroy the cover of the comic book, which most collectors consider to be the most important part of the collectable comic book. There is therefore a need for a comic book protection apparatus which will allow a collector to read the comic book without contacting substantial portions of the page surfaces. It is also important that a comic book protection apparatus be constructed of a flexible, generally transparent material to enable viewing of the comic book when placed within the protection apparatus.

Several prior art devices have been proposed to address the above-stated needs. These include U.S. Pat. Nos. 4,861,073, to Poretski, 4,477,013, to Herrin, 1,330,894 to Muffley, and 4,128,262. to DuCorday. Each of these prior art devices, however, include inherent limitations which prevent the devices from being used with collectable comic books. For example, Poretski discloses a paper-holding device which includes a plurality of intersecting crease lines which allow the device to be folded such as is commonly done with newspapers and the like. Clearly, such folding would be detrimental to storage and protection of a comic book. Both Herrin and Muffley will cause damage to comic books held therein, as Muffley requires perforations through the comic book (see column 2, lines 67–71), and Herrin includes a hinged line 18 which "pinches" a comic book held within the file folder. In any event, each of the prior art devices above include only a single layer of protection for a comic book held within the protection device. As merely opening any of the prior art devices exposes the comic book to elemental damage, there is a need for a protection device which will enclose the comic book cover within a second layer of protection, thus preventing accidental exposure of the comic book to elemental damage.

Therefore, an object of the present invention is to provide a comic book protection apparatus.

Another object of the present invention is to provide a comic book protection apparatus which includes a document cover having generally flexible, generally rectangular front and rear panels and a spine extending between and connected to the front and rear panels, the cover being constructed of a generally translucent material and being of a size and shape to cover and protect a comic book between the front and rear panels.

Another object of the present invention is to provide a comic book protection apparatus which further includes a generally rectangular cover-receiving envelope having front and rear envelope panels, the panels connected to each other on at least two sides, the envelope being of a size and shape to receive and enclose the document cover between the front and rear envelope panels and the envelope constructed of a generally translucent material.

Another object of the present invention is to provide a comic book protection apparatus which will not damage or destroy comic books being held therein.

Another object of the present invention is to provide a comic book protection apparatus which includes semicircular thumb notches formed in the outer edges of the document cover to facilitate paging through a comic book held within the document cover.

Another object of the present invention is to provide a comic book protection apparatus which is constructed of generally semi-flexible material to prevent folding, bending or mutilating of comic books held within the comic book protection apparatus.

Finally, an object of the present invention is to provide a comic book protection apparatus which is simple to manufacture yet provides substantially complete protection for comic books held within the comic book protection apparatus.

SUMMARY OF THE INVENTION

The present invention provides a- comic book protection apparatus which includes a document cover having generally flexible, generally rectangular front and rear panels, each having one longitudinal edge. The edges of the front and rear panels are positioned in vertical spaced relation. The document cover further includes a spine extending between and connected to one of the longitudinal edges of each of the front and rear panels. The spine is connected to the front and rear panels at generally right angles thereby forming a comic book receiving channel. The cover is constructed of a generally translucent material and is of a size and shape to substantially cover and protect a comic book between the front and rear panels with the spine of the comic book adjacent to and contacting the spine of the document cover.

The invention further includes a generally rectangular cover-receiving envelope having front and rear envelope panels, the panels being connected to each other on at least two sides. The envelope is of a size and shape to receive and enclose the document cover between the front and rear envelope panels. The envelope is also constructed of a generally translucent material.

The present invention thus provides a substantial improvement over those protection devices found in the prior art. First of all, a comic book may be held within the document cover without damaging the comic book, as some prior art devices require perforations in the comic book to secure the comic book within the document cover. Also, the present invention protects against folding or bending of the comic book held within the document cover, which is a vital feature for protection of comic books. Also, as the document cover-receiving envelope are each constructed of generally translucent materials, a comic book held within the document cover may be viewed without removing the comic book from the document cover. Finally, the two layers of protection for the comic book provided by the document cover and cover-receiving envelope substantially eliminate any damage caused by external contact with the comic book. Therefore, the present invention is believed to be superior to those protection devices found in the prior art.

DESCRIPTION OF THE PREFERRED EMBODIMENT

Figure 1:
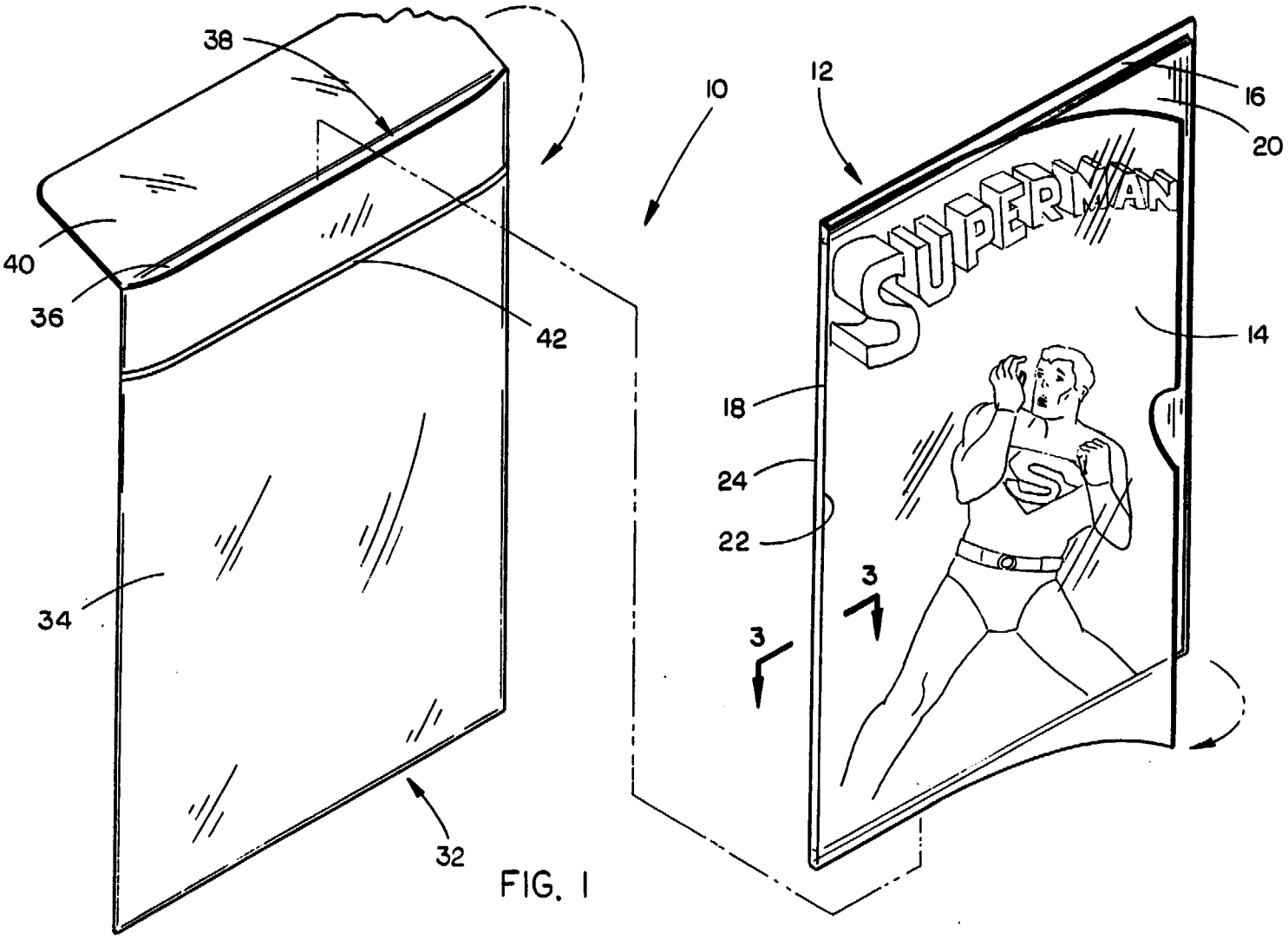
FIG. 1 is a perspective view of the comic book protection apparatus.

The comic book protection apparatus 10 of the present invention is shown in its preferred embodiment in FIGS. 1–4 as including a document cover 12 having front and rear panels 14 and 16 and a spine 18 extending between and connected to the front and rear panels 14 and 16. The front and rear panels 14 and 16 are preferably rectangular in shape and constructed of relatively flexible transparent plastic sheeting to allow for viewing of the comic book 20 through either of the panels 14 and 16. The preferred thickness of the plastic sheeting would be between 9 and 15 mil., and may be a plastic film such as DuPont polyester mylar film or other such plastic sheeting. It is preferred that the front and rear panels 14 and 16 be of sufficient rigidity to prevent accidental folding or bending of the comic book 20 retained within the document cover 12, yet still be flexible enough to allow for paging through the comic book 20.

Figure 3:
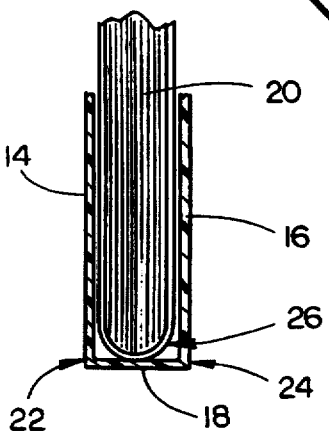
FIG. 3 is a sectional end view of the document cover taken along line 3—3 in FIG. 1 showing how a comic book is held within the document cover.

The spine 18 extends between and is connected to the longitudinal edges 22 and 24 of each of the front and rear panels 14 and 16, as shown in FIG. 1. As shown best in FIG. 3, the front and rear panels 14 and 16 are connected to the spine 18 at generally right angles thereby forming a comic book receiving channel 26. It is preferred that the spine 18 have a rectangular shape with a length approximately equal to the length of the longitudinal edges 22 and 24 and a width of between one-sixteenth (1/16) inches and one-half (½) inch. In this matter, a comic book 20, when placed within the document cover 12, may be positioned adjacent to and contacting the spine 18, as shown in FIG. 3. The width of the spine 18 prevents any "pinching" of the spine of the comic book 20, thus preventing damage to the comic book 20. It is preferred that the spine 18 be constructed of similar material to that used in constructing the front and rear panels 14 and 16.

Figure 2:
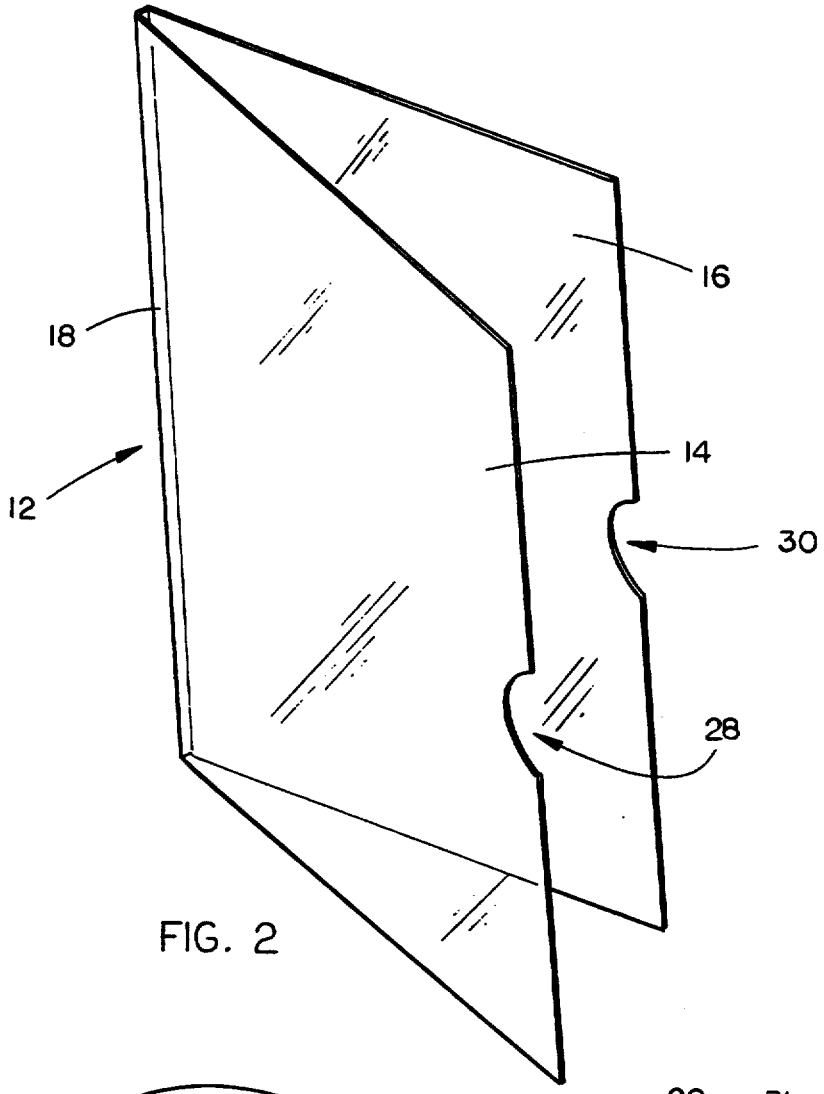
FIG. 2 is a perspective view of the document cover of the present invention including semi-circular thumb notches.
Figure 4:
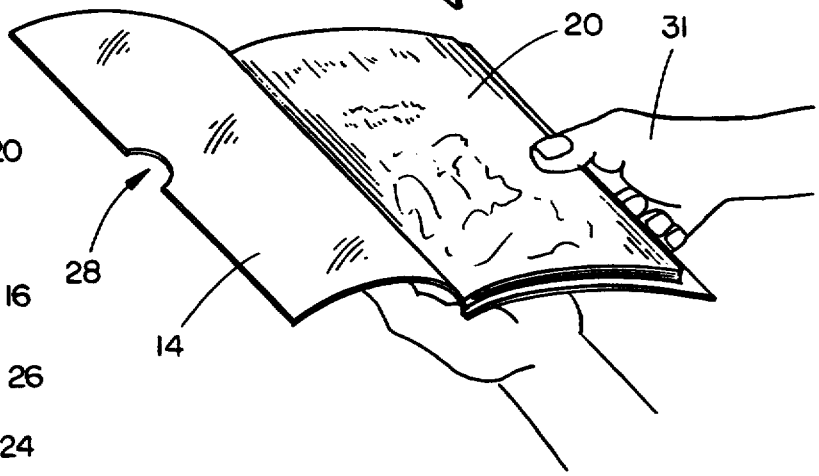
FIG. 4 is a perspective view of the present invention being used during feeling of a comic book.

The front and rear panels 14 and 16 may each further include a semi-circular thumb notch 28 and 30 formed in the outer edges of each of the panels 14 and 16, as shown in FIG. 2. The thumb notches 28 and 30 may be used by a person 31 wishing to view the contents of the comic book as shown in FIG. 4 by supporting the document cover 12 in one hand and using the thumb alone to go through the pages of the comic book. Contact with comic book surfaces is thus minimized., thus substantially preventing damage from fingerprints and finger tip oils which may be transferred to the pages. It is preferred that the thumb notches 28 and 30 extend sufficiently inwards to allow contact with the comic book 20 held within the document cover 12. It is important to note that minimization of skin contact with collectable items is highly desirable and is a feature not found in the prior art. It is further to be understood that the thumb notches 28 and 30 may be formed in any location on the front and rear panels 14 and 16, but the preferred location is shown in FIGS. 2 and 4.

While the document cover 12 when used by itself provides a high degree of protection for comic books, this level of protection is not sufficient for collectable comics, some of which may be worth thousands of dollars. Therefore, the present invention further includes a cover-receiving envelope 32 which includes front and rear envelope panels 34 and 36 connected to each other on three sides thereof, as shown in FIG. 1. The cover-receiving envelope 32 is preferably of a size and shape to receive and enclose the document cover 12, the document cover 12 being inserted into the cover-receiving envelope 32 through top slot 38, as shown in FIG. 1. It is preferred that the front and rear envelope panels 34 and 36 be constructed of slightly thicker plastic sheeting than that used to construct the document cover 12. However, it is preferred that the plastic sheeting for the cover-receiving envelope 32 still be substantially transparent to allow for viewing of the comic book 20.

For retaining the document cover 12 within the cover-receiving envelope 32 a flap 40 is provided, the flap 40 pivotally mounted on one edge of the top slot 38 such that the flap 40 may be folded over to cover and seal the top slot 38 as shown by the curved arrow in FIG. 1. The flap 40 may be secured in closed position by any standard means, however, FIG. 1 shows the flap 40 fitting under a strap 42 such that frictional contact between the flap 40 and the strap 42 and the front envelope panel 34 retains the flap 40 in closed position.

It is the combination of the document cover 12 and cover-receiving envelope 32 which provide superior protection for comic books held within the comic book protection apparatus 10. When the document cover 12 is used alone to protect a comic book, the comic book 20 may accidentally fall out of the document cover 12 or the comic book itself may be damaged by contact with foreign substances. Use of the cover-receiving envelope 32 alone, on the other hand, may result in damage to the comic book due to the insertion of the comic book 20 into the cover-receiving envelope 32 as there is no protection for the comic book from frictional contact with envelope surfaces or contact with envelope edges which may result in bending or cutting of the comic book. When the document cover 12 and cover-receiving envelope 32 are used in combination, however, the comic book 20 is placed within the document cover 12 which is then slid into the cover-receiving envelope 32. Frictional contact between the comic book 20 and cover-receiving envelope 32 is thus eliminated, thus protecting the comic book 20 during the sliding in process. The flap 40 may then be closed to seal the top slot 38 and protect the comic book 20 from any elemental damage. Furthermore, as both the document cover 12 and cover-receiving envelope 32 are transparent, a collector may view his collection of comic books without removing the comic book 20 from the comic book protection apparatus 10. Furthermore, the document cover 12 and cover-receiving envelope 32 combine to reinforce one another to provide additional rigidity for the comic book protection apparatus 10. This acts to further prevent accidental folding or bending of a comic book 20 held within the protection apparatus 10. This combination of protection and viewing capability is unmatched by the prior art.

It is to be understood that numerous modifications and adjustments to the present invention may be performed. For example, the size and shape of the protection apparatus may be adjusted to accommodate any type of comic book presently collected. Additionally, various other changes to the elements described herein may be performed which will still .fall within the intended broad scope of the appended claims.

It is thus believed that the present invention provides a substantial improvement over those devices found in the prior art. There has thus been set forth and described an invention which accomplishes at least all of these stated objectives.

I claim:

1. A collector document protection apparatus comprising;

a document cover comprising;

generally flexible generally rectangular front and rear panels each having at least one longitudinal edge and inner and outer faces, said edges positioned in vertical spaced relation;

a spine extending between and connected to one of said longitudinal edges of each of said front and rear panels;

said spine connected to said front and rear panels at generally right angles thereby forming a document receiving channel;

said inner faces of said front and rear panels being generally smooth and generally free of projections, burrs and protrusions such that said inner faces of said panels may contact a document supported therebetween without risk of damage thereto;

said cover constructed of a generally translucent material;

said cover being of a size and shape to substantially cover and protect a document between said front and rear panels; and a generally rectangular cover-receiving envelope having front and rear envelope panels, said panels connected to each other on at least two sides, said envelope being of a size and shape to receive and enclose said document cover between said front and rear envelope panels, said envelope constructed of a generally translucent material.

2. The collector document protection apparatus of claim 1 wherein said front and rear panels each further comprise at least one thumb-receiving notch formed extending inwards from an edge thereof such that access to a document within said- cover is facilitated.

3. The collector document protection apparatus of claim 1 wherein said spine further comprises a generally rectangular, longitudinally extended strip of flexible material having opposite longitudinal edges, said longitudinal edges of said spine each connected to one of said longitudinal edges of one of said front and rear panels.

4. The collector document protection apparatus of claim 1 wherein said front and rear panels and said spine are constructed of transparent plastic sheeting.

5. The collector document protection apparatus of claim 1 wherein said document cover is of a size and shape to substantially cover and protect a comic book positioned between said front and rear panels.

6. The collector document protection apparatus of claim 5 wherein said document-receiving channel is of a size and shape to receive a spine of a comic book within said channel, the spine of the comic book contacting said spine of said document cover.

7. The collector document protection apparatus of claim 1 wherein said front and rear envelope panels further comprise opposite longitudinal sides and opposite transverse sides, said longitudinal sides of said front and rear envelope panels connected to each other and one of said .transverse sides of said front and rear envelope panels connected to each other thereby leaving a document cover receiving top slot in said envelope.

8. The collector document protection apparatus of claim 7 wherein said cover-receiving envelope is constructed of generally flexible plastic sheeting which is impervious to liquids.

9. The collector document protection apparatus of claim 1 wherein said document cover and said cover-receiving envelope are constructed of a generally rigid material to substantially prevent bending or folding of documents retained within said document cover.

10. A comic book protection apparatus for protecting a comic book having front and rear covers, said apparatus comprising;

a comic book cover comprising;

generally semi-flexible generally rectangular front and rear panels each having at least one longitudinal edge and inner and outer faces, said edges positioned in vertical spaced relation;

a spine extending between and connected to one of said longitudinal edges of each of said front and rear panels;

said spine connected to said front and rear panels at generally right angles thereby forming a comic book-receiving channel;

said cover constructed of a generally transparent material;

said cover being of a size and shape to substantially cover and protect a comic book between said front and rear panels;

said inner faces of said front and rear panels being free of cover-receiving pockets such that movements of the front and rear covers of a comic book are independent of movements of said front and rear panels;

said spine and said front and rear panels cooperating to cover a comic book such that the comic book may be placed within said cover adjacent to and contacting said spine; and a generally rectangularly cover-receiving envelope having front and rear envelope panels, said panels connected to each other on at least two sides; said envelope being of a size and shape to receive and enclose said document cover between said front and rear envelope panels, said envelope constructed of a generally transparent material.

11. A collector document protection apparatus comprising;

a document cover comprising;

generally flexible generally rectangular front and rear panels each having at least one longitudinal edge, said edges positioned in vertical spaced relation;

said spine connected to said front and rear panels at generally right angles thereby forming a document receiving channel;

said cover constructed of a generally translucent material;

said cover being of a size and shape to substantially cover and protect a document between said front and rear panels;

a generally rectangular cover-receiving envelope having front and rear envelope panels, said panels connected to each other on at least two sides, said envelope being of a size and shape to receive and enclose said document cover between said front and rear envelope panels, said envelope constructed of a generally translucent material;

said front and rear envelope panels including opposite longitudinal sides and opposite transverse sides, said longitudinal sides of said front and rear envelope panels connected to each other and one of said transverse sides of said front and rear envelope panels connected to each other thereby leaving a document cover receiving top slot in said envelope; and flap means pivotally mounted on said envelope adjacent said top slot, said flap means operative to pivot over and generally completely close said slot, thereby preventing damage to documents placed within said cover-receiving envelope.

* * * * *